US005219301A

United States Patent [19]

Frantz

[11] Patent Number: 5,219,301

[45] Date of Patent: Jun. 15, 1993

[54] KEYING FOR A SHIELDED ELECTRICAL CONNECTOR

[75] Inventor: Robert H. Frantz, Newville, Pa.

[73] Assignee: AMP Incorporated, Harrisburg, Pa.

[21] Appl. No.: 928,905

[22] Filed: Aug. 12, 1992

Related U.S. Application Data

[62] Division of Ser. No. 766,889, Sep. 27, 1991, Pat. No. 5,158,474.

[51] Int. Cl.[5] ..... H01R 13/627

[52] U.S. Cl. ..... 439/362; 439/680

[58] Field of Search ..... 439/607-610, 439/677-681, 904, 906, 362

[56] References Cited

U.S. PATENT DOCUMENTS

| | | | |
|---|---|---|---|
| 2,902,665 | 9/1959 | D'Amico . | |
| 3,177,461 | 4/1965 | Hagan et al. . | |
| 3,555,491 | 1/1971 | Moss . | |
| 4,109,987 | 8/1978 | Bourdon | 439/680 X |
| 4,519,667 | 5/1985 | Canning et al. . | |
| 4,568,134 | 2/1986 | DiMondi . | |
| 4,759,730 | 7/1988 | Sappington et al. | 439/622 |
| 4,778,411 | 10/1988 | Rudy, Jr. et al. | 439/681 |
| 4,781,626 | 11/1988 | Lazarchik | 439/680 |
| 4,895,535 | 1/1990 | Emadi et al. | 439/607 X |
| 4,929,184 | 5/1990 | Emadi et al. | 439/681 |
| 4,934,950 | 6/1990 | Green et al. | 439/681 |
| 4,935,847 | 6/1990 | Welsh | 439/680 X |
| 4,952,175 | 8/1990 | Waters et al. | 439/681 |
| 4,990,099 | 2/1991 | Marin et al. | 439/284 |
| 5,030,141 | 7/1991 | Winstein et al. | 439/680 |

FOREIGN PATENT DOCUMENTS

| | | | |
|---|---|---|---|
| 2498829 | 7/1982 | France | 439/362 |

*Primary Examiner*—Larry I. Schwartz
*Assistant Examiner*—Khiem Nguyen
*Attorney, Agent, or Firm*—David L. Smith; Anton P. Ness

[57] ABSTRACT

In a shielded electrical connector assembly (2) for mating with a mating electrical connector (206) and including a connector receiving shell, a metal back shell (12 or 14) and an insulating cover (8 or 10) therefor, a coding key (18) has a keying part (184) projecting forwardly from the assembly and a keying abutment (190) which is of regular polygonal cross section. The abutment (190) is connected to the keying part (184) by means of a neck (189) to define a rib (106) which receives a flange (114) on the back shell (14) and a flange (42) on the connector receiving shell (6), the key (18) being thereby held against axial movement. The key (18) defines a through passage (194) for receiving a jack screw (16) with a mating end (202) thereof in the keying part (184). The shaft (199) of the jack screw is accommodated in recesses (164) in the back shell cover (19). A flat (192) of the abutment (190) engages a flat (182) in the cover (10) and a further flat (192) of the abutment (190) engages a side wall (76) of the back shell (14), so that the key (18) is retained in a predetermined angular orientation.

2 Claims, 13 Drawing Sheets

KEYING FOR A SHIELDED ELECTRICAL CONNECTOR

RELATED APPLICATION INFORMATION

This is a divisional application of U.S. patent application Ser. No. 07/766,889 filed Sep. 27, 1991, now U.S. Pat. No. 5,158,474.

BACKGROUND OF THE INVENTION

This invention relates to the keying of a shielded electrical connector assembly for mating with a mating electrical connector and also relates to a key for use in such an assembly, and to back shells therefor.

U.S. patent application Ser. No. 3,555,491 discloses an electrical connector provided with coding keys for mating with those of a mating electrical connector. Each key comprises a keying part projecting forwardly of the connector and behind the keying part and spaced rearwardly thereof a part of regular polygonal cross section received in a cavity of the same cross section in an insulating housing of the connector. The polygonal part of the key can therefore be inserted into the cavity in a number of different angular orientations depending upon the number of flats that the polygonal part has. The keying part of the key is such that it can only be mated with a complementary key having the same angular orientation. This ensures that the connector can only be mated with a mating connector the keys of which have said same angular orientation. Each key has a through axial passage for receiving a jack screw for securing the connector to the mating connector. U.S. patent application Ser. No. 2,902,665, similarly discloses an electrical connector having keys for receiving jack screws, each key having a polygonal part for reception in a polygonal cross section opening. In this case, the opening is formed in a flange projecting from a protective shell of the connector. Each key is secured in its opening by means of a collar on one side of the flange and a nut threaded onto the key on the other side of the flange. In order to change the axial orientation of the key, the nut must be loosened and then re-tightened. There is disclosed in U.S. patent application Ser. No. 3,177,461, a printed circuit edge connector having keys for mating with complementary keys on a printed circuit board, each key of the edge connector comprising a part in the form of a regular polygon and a keying part of substantially semi-circular cross section, formed integrally therewith. The polygonal part has a central hole receiving a screw threaded pin which in turn receives a nut which can be tightened to secure the key in a selected angular orientation with respect to a reduced cross section end portion of the housing of the connector, through which portion the pin extends. The polygonal part is retained in its selected angular orientation, before the nut is tightened, by the engagement of an end face of the connector housing with a flat of the polygonal part U.S. patent application Ser. No. 4,929,184 relates to a shielded electrical connector, the shield of which has end flanges with polygonal openings therein for receiving polygonal parts of keys. Each key has a threaded shank receiving a nut for securing the key in its opening, or has a tapped bore receiving a jack screw which serves to secure the key in its opening. There is disclosed in U.S. patent application Ser. No. 4,934,950, a key having a polygonal part which is secured in a polygonal cross section opening in a flange of an electrical connector housing by means of a jack screw having smooth shank which is inserted through the key and into a smooth bore of a smooth bored nut. A pin in inserted through a radial hole in the nut and through an aligned hole in the shank of the jack screw. U.S. patent application Ser. No. 4,934,950 further discloses a key for mating with the key just described, having a polygonal cross section part which is received in a polygonal opening in the flange of the mating connector housing, a screw threaded shank projecting from the polygonal part, and receiving a locking ring for securing the key in its opening.

SUMMARY OF THE INVENTION

The present invention is intended to provide, in a shielded electrical connector assembly for mating with a mating electrical connector and including a metal back shell and an insulating cover therefor, a keying system in which polygonal parts of the keys are secured in their desired angular orientations, without the use of polygonal cross section openings for receiving the polygonal parts, since such openings are not usually providable in connectors of the type to which the present invention relates, and without the use of nuts or other separate fasteners for securing the keys in position.

According to one aspect of the invention, in a shielded electrical connector assembly for mating with a mating electrical connector and including a metal back shell and an insulating cover therefor, a keying system comprises a key having an elongate keying part projecting forwardly from said assembly for mating with a complementary key on said mating connector, the keying part having a forward and a rear end, and a keying abutment of regular polygonal cross section, fixed to the rear end of the keying part and being spaced therefrom, in coaxial relationship with the keying part, the key defining a through passage for receiving a jack screw with a mating end of the jack screw in the keying part. A key is secured against axial movement by means of at least one projection, at least of the back shell, which extends between the keying part and the keying abutment of the key. A selected flat of the keying abutment is arranged in surface to surface engagement with a flat in the back shell cover so that the key is secured in a selected angular orientation. Preferably, a further flat of the keying abutment engages a side wall of the back shell in surface to surface engagement therewith. The shaft of the jack screw is preferably accommodated in recesses formed, for example, in transverse side walls of the back shell cover, the keying part of the key being accommodated in a further recess in the cover located forwardly of the recesses accommodating the jack screw shank. The jack screw and the key are accordingly very easily assembled to the back shell and the cover without the need for separate fastening means. The invention further concerns, a kit of parts for use in the construction of a shielding assembly for a shielded electrical connector, said kit of parts including a pair of keys and a pair of jack screws, in which no extra parts are needed for securing the keys in their chosen angular orientations for accommodating the jack screws. The invention further relates to a one piece, cast metal key which is suitable for use in the kit of parts, and to a pair of mating back shells.

DESCRIPTION OF THE PREFERRED EMBODIMENT

Figure 1:
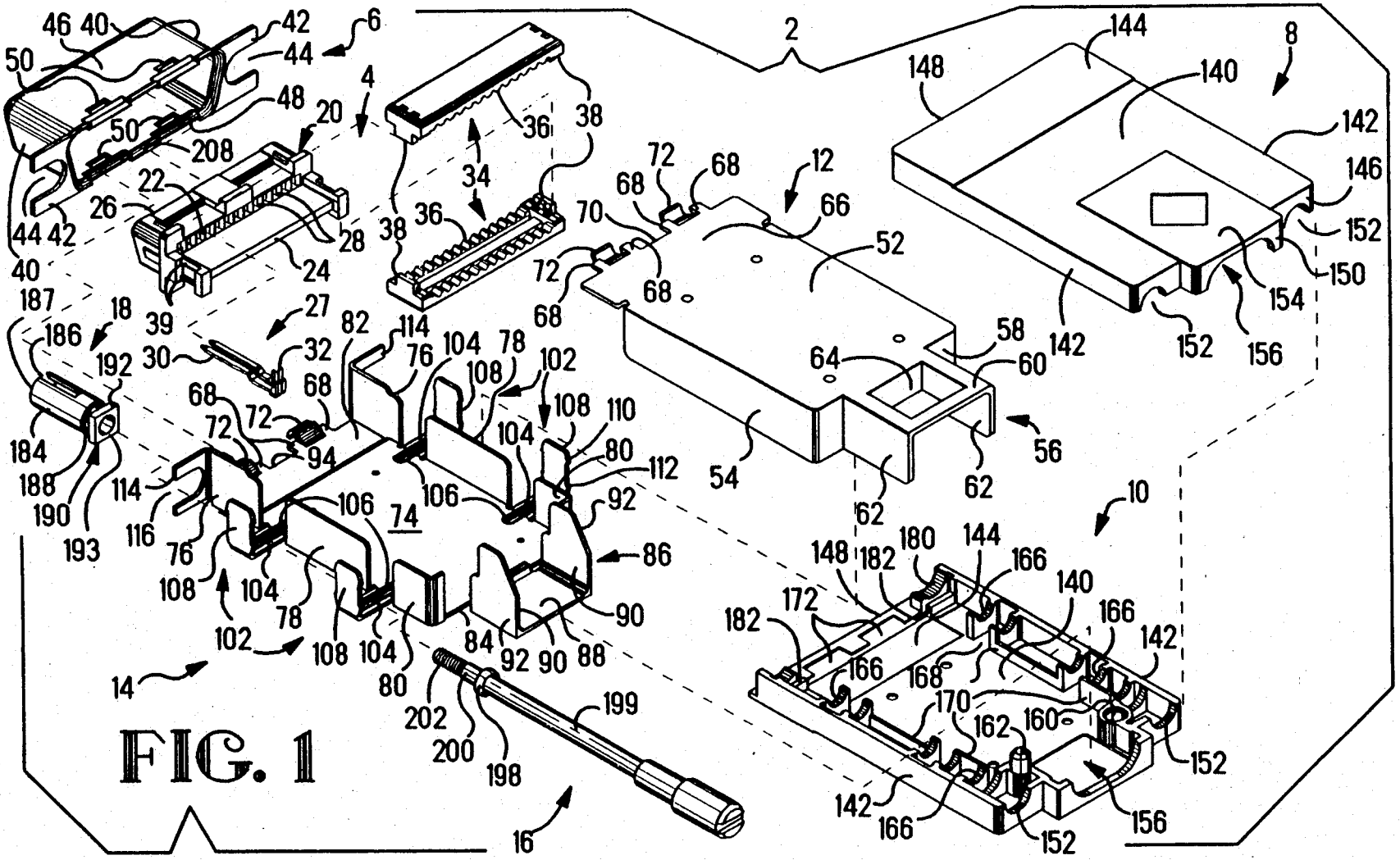
FIG. 1 is an exploded isometric view of a shielded electrical connector assembly comprising a drawn metal shell, a first electrical connector for reception therein, upper and lower connector covers, upper and lower metal back shells, jack screws, only one of which is shown, and keys therefor, only one of which is shown.

As shown in FIG. 1 a shielded electrical connector assembly 2 comprises a multi-contact electrical connector 4, a drawn metal shell 6, for receiving the connector 4, upper and lower insulating covers 8 and 10, respectively, upper and lower metal back shells 12 and 14, respectively, a pair of jack screws 16 (only one of which is shown in FIG. 1) and a pair of keys 18 (only one of which is shown in FIG. 1).

The connector 4, which is constructed generally according to the teaching of U.S. Pat. No. 4,781,615, which is incorporated herein by reference, comprises an insulating housing 20 from which projects rearwardly, from a terminal receiving face 22 of the housing 20, a contact support plate 24. The housing 20 has a mating face 26 opposite to the terminal receiving face 22. Terminal receiving cavities 28 open into both of the faces 22 and 26 and receive electrical terminals 27 (only two of which have been shown in FIG. 1 for clarity), each having a mating portion 30 received in a respective cavity 28 and a wire receiving slotted plate 32 projecting normally from mating portion 30. The cavities 28 and thus the terminals 27 are arranged in two rows, one on each side of the support plate 24. Upper and lower insulating, terminating covers 34 having wire stuffer means 36 thereon, are provided for stuffing wires (not shown in FIG. 1) into the respective slotted plate 32 on respective sides of the support plate 24. Terminating covers 34 are latchable to the plate 24 by means of latch arms 38 at the ends of the covers 34 cooperating with latch means 39 on each end of connector 4.

The drawn shell 6, which is open at both its forward and its rear end, receives the connector 4 with the plate 24 thereof projecting rearwardly from the shell 6. From each lateral rear edge of the shell 6, there projects normally of the respective side wall 40 of the shell 6, a key anchoring flange 42 defining a laterally opening, U-shaped blind slot 44. Proximate to the rear edge thereof each of the upper and lower walls 46 and 48, respectively, of the shell 6 is formed with two spaced slots 50 each extending lengthwise of said rear edge.

Figure 2:
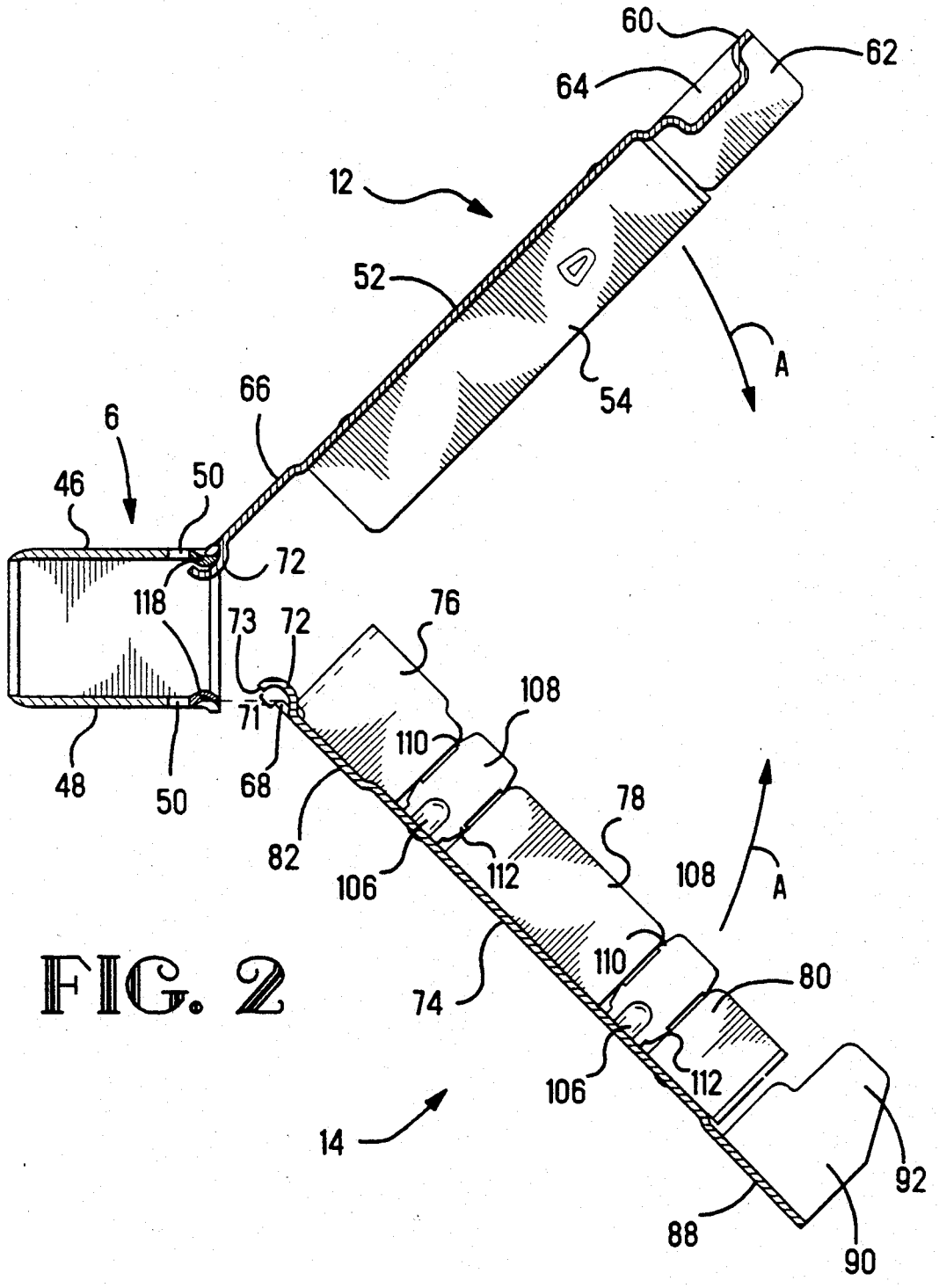
FIG. 2 is a longitudinal sectional view, partly exploded, illustrating the manner in which the back shells are assembled to the drawn shell.

The upper back shell 12 comprises an upper wall 52, side walls 54 depending therefrom, and a lower back shell anchoring member 56 projecting from a rear wall 58 of the shell 12. The anchoring member 56 comprises a planar upper wall 60 from which depend opposite planar side walls 62. The upper wall 60 is formed with a recess 64. The back shell 12 is open both forwardly thereof and below, as best seen in FIG. 2. There project forwardly from upper wall 52, a flat plate 66 which may be offset from upper wall 52. Extending from the forward end of plate 66 and substantially coplanar therewith are two pairs of spaced rectangular tabs 68, the pairs of tabs 68 being spaced from each other longitudinally of the forward edge 70 of the plate 66. Each tab 68 extends to a respective distal end 69. Between the tabs 68 of each pair, there projects from the edge 70, a smoothly arcuate, substantially semi-circular cross section pivot hook 72 extends to distal end 73 and which is bowed downwardly with respect to the plate 66.

The lower back shell 14 comprises a planar lower wall 74 from each of two opposite lateral edges of which upstand forward, intermediate and rear side wall sections 76, 78 and 80, respectively. The wall section 76 projects from a slightly downwardly offset forward plate 82 of the wall 74. There projects from the rear edge 84 of the wall 74, an upper back shell anchoring and cable strain relief member 86 having a lower wall 88 from each lateral edge of which upstands an anchoring flange 90 having an upper tapered portion 92 which is bendable inwardly of the member 86 with respect to the remainder of the flange 90.

There project forwardly from the forward edge 94 of the plate 82, two pairs of spaced, rectangular tabs 68 identical with those of the shell 12, spaced longitudinally of the forward edge 94 of the plate 82. Between the tabs 68 of each pair is a smoothly arcuate, substantially semi-circular cross section pivot hook 72 identical with the pivot hook 72 of the shell 12 but being oppositely oriented, being bowed upwardly with respect to the plate 82.

Figure 11:
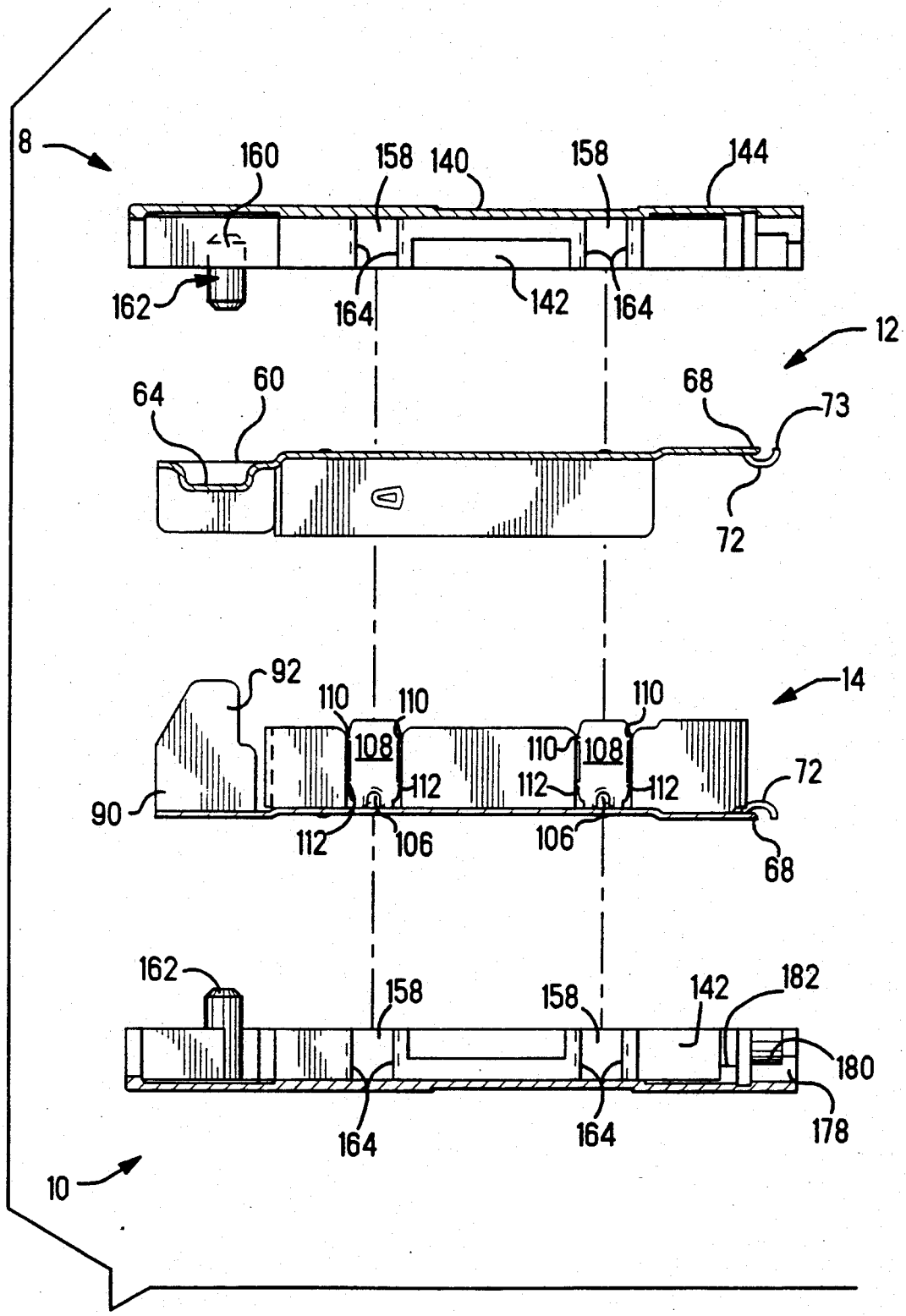
FIG. 11 is a partial perspective view of an outrigger positioned above a channel in a lower cover.

Between the wall sections 76 and 78 and between the wall sections 78 and 80 on each side of the lower wall 74, there projects laterally outwardly thereof an outrigger 102 having a supporting strip 104 extending from the wall 74 in the plane thereof. Supporting strip 104 may be formed with a reinforcing rib 106. A retention flange 108 upstands from the outer end of each support strip 104, normally thereof and normally of the wall 74. Each flange 108 is formed on each lateral edge thereof with a pair of vertically spaced upper and lower retention barbs 110 and 112, respectively, as will best appear from FIGS. 11 and 12. The ribs 106 also extend into the flanges 108, thereby reinforcing them against being bent out of their upright positions.

From the forward end of each forward sidewall section 76, there projects normally thereof, a key anchoring flange 114 defining a laterally opening U-shaped blind slot 116, the flanges 114 being substantially identical with the flanges 42 of the drawn shell 6.

Figure 3:
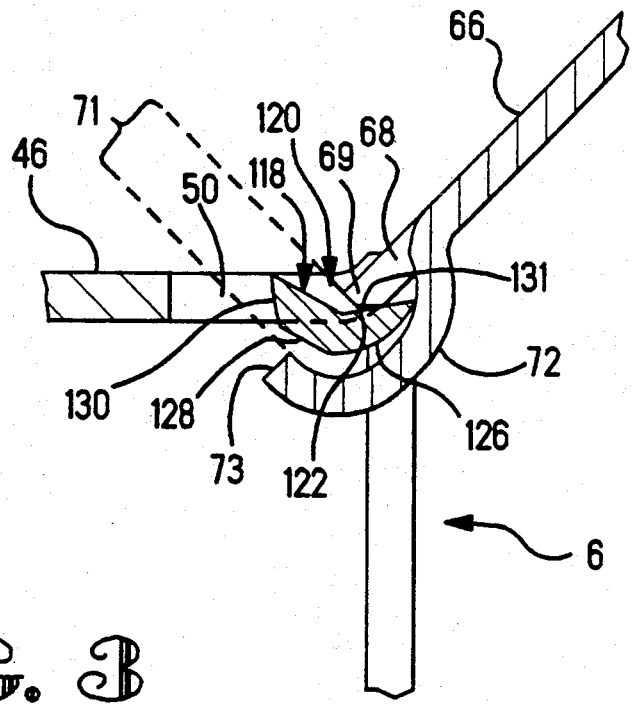
FIG. 3 is an enlarged fragmentary view illustrating a first step in the assembly of one of the back shells to the drawn shell.
Figure 4:
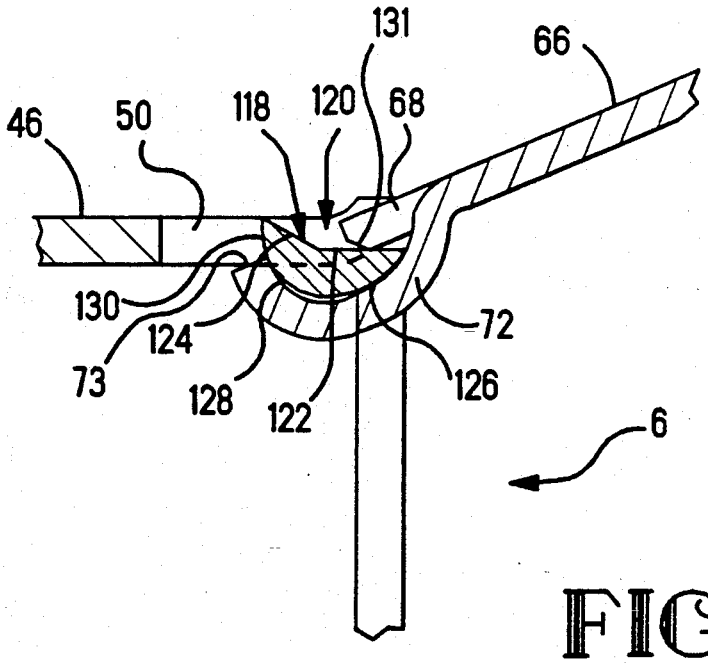
FIG. 4 is a similar view to that of FIG. 3 illustrating a subsequent step in the assembly of the back shell to the drawn shell.

As best seen in FIG. 2 to 4, there extends forwardly from the rear edge of each of the upper and lower walls 46 and 48 of the drawn shell 6, in the respective slot 50 thereof, a bearing member 118 bridging the slot 50 and having on one side thereof, in the slot 50, an outer face comprising a rearward flat bearing surface 122 substantially parallel with the wall 46 or 48, as the case may be, and adjoining a further flat surface 124 which is inclined away from the surface 122 outwardly of, and away from, the respective wall 46 or 48 as the case may be. The surfaces 122 and 124 collectively define an indent 120. The inner face of the member 118 has a smoothly arcuate, rearward surface 126, protruding out of the slot 50 and merging forwardly with a flat 128 which extends obliquely towards a forward surface 130 projecting into the slot 50. Each tab 68 of the back shells 12 and 14 has a chamfered bearing surface 131 at distal end 69 facing the respective hook 72 (FIGS. 3 and 4) and defining between distal end 69 and distal end 73, from the side view of FIG. 3, a gap 71.

The manner in which the back shells 12 and 14 are assembled to the drawn shell 6 will now be described with particular reference to FIGS. 2 to 4. As shown in FIG. 2, the pivot hook 72 of each of the back shells 12 and 14 is inserted into the open rear of the drawn shell 6, so as to extend about the inner surface of the respective bearing member 118 as shown in FIG. 3. Member 118 is received in gap 71 with the chamfered surfaces 131 of the tabs 68 on each side of the hook 72 engaging the surface 122 of the respective member 118. The back shells 12 and 14 are rotated towards each other in the direction of the arrows A in FIG. 2, about the chamfered bearing surfaces 131 of the tabs 68, so that the inner surface of each hook 72 engages about the arcuate surface 126 of the respective bearing member 118 as shown in FIG. 4. During the rotation of the shells 12 and 14 beyond approximately the orientation shown in FIG. 4, each bearing member 118, captured between tabs 68 and with the result that the hook 72, is slightly torsioned with the result that excellent electrical contact and latching mechanical interconnection are established between the shells 6 and 12 as Well as shells 6 and 14.

Figure 5:
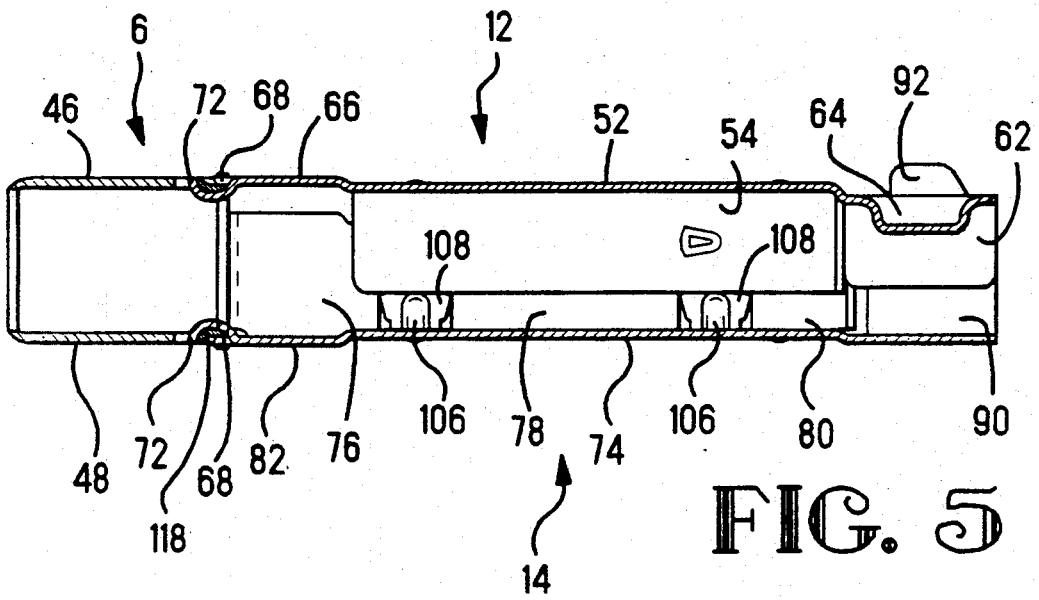
FIG. 5 is a longitudinal sectional view showing the back shells fully assembled to the drawn shell.
Figure 6:
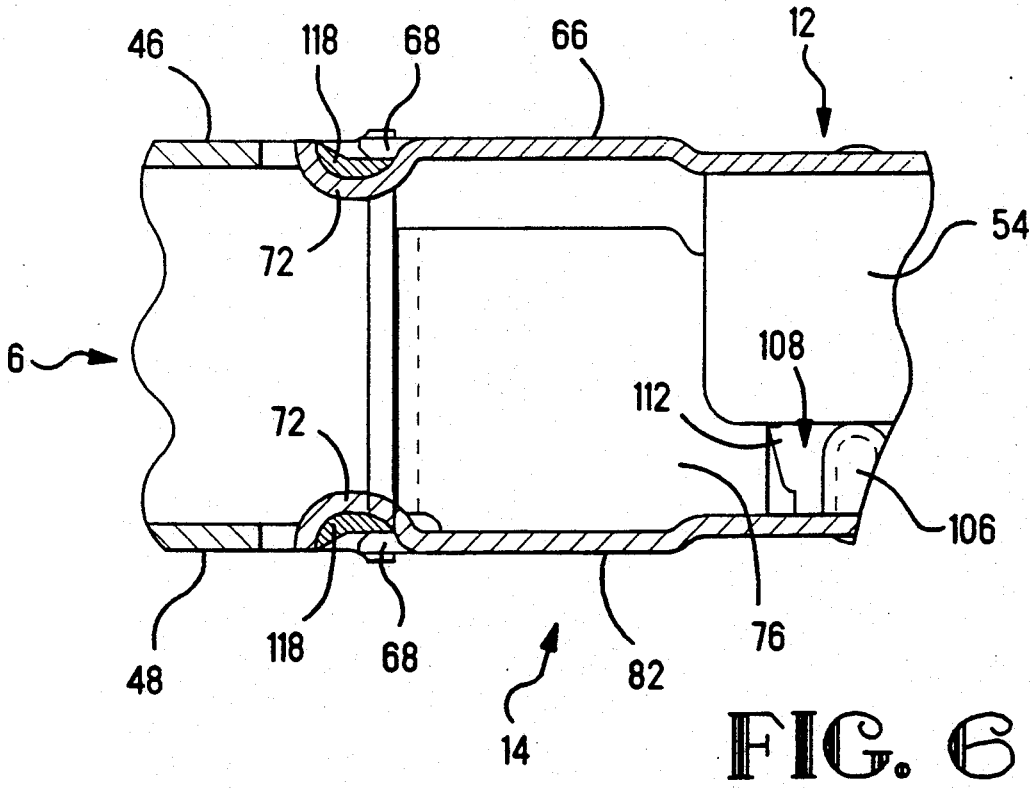
FIG. 6 is an enlarged fragmentary view illustrating details of FIG. 5.

Such rotation of the back shells 12 and 14 is continued until the plate 66 of the shell 12 is coplanar with the wall 46 of the drawn shell 6, and the plate 82 of the shell 14 is coplanar with the wall 48 of the drawn 6, as shown in FIGS. 5 and 6. Each hook 72 then embraces the surfaces 126, 128 and 130 of the respective bearing member 118, having slid there around, each tab 68 lying flat against the surface 122 of the respective bearing member in the fully assembled position of the shells 6, 12 and 14.

To secure the shells 6, 12 and 14 in their assembled condition with shells 12 and 14 fully rotated as described above, the tapered portion 92 of each flange 90 of the back shell 14 is bent over wall 60 and down into the recess 64 of the back shell 12 in accordance with the teaching of application Ser. No. 07/662,587 Filed Feb. 28, 1991 which is hereby incorporated by reference.

Sidewall 54 is received adjacent to sidewall sections 76,78 and 80. As seen best in FIG. 5, sidewall 54 substantially covers the gap between sidewall sections 76 and 78, as well as the gap between sidewall sections 78 and 80, where outriggers 102 extend from lower backshell 14. In this manner, effective shielding around the entirety of cavity 146 is maintained.

Before the shells 6, 12 and 14 are assembled as described above, the connector 4 to which the wires of a cable C (FIGS. 14 to 17) have been terminated by tooling or by latching the terminating covers 34 to the contact support plate 24 of the connector, is inserted into the drawn shell 6 with terminating covers 34 projecting rearwardly therefrom and the cable wires extending rearwardly from the covers 34. In the assembled position of the shells 6, 12 and 14, the lower cover 34 is proximate to and may engage the plate 82 of the shell 14. The upper cover 34 is proximate to and may engage the plate 66 of the shell 12. The cable wires extend from terminals 27 of the connector 4, rearwardly through the shells 12 and 14, the cable end portion from which the wires extend, being trapped between the wall 88 of the strain relief member 86 and the base of the recess 64. Strain relief for the cable C is thereby provided when, as disclosed above, tapered portions 92 of flanges 90 are bent over wall 60.

The keys 18, the jack screws 16 and the connector covers 8 and 10 can be assembled to the shells 6, 12 and 14 subsequent to shells 6, 12 and 14 being assembled as described above, and subsequent to shells 6, 12 and 14 being assembled to connector 4 having conductors of cable C.

As shown in FIGS. 1, 9, 10, 11 and 12 sidewalls 142 of covers 8 and 10 are formed with internal channel-like recesses 158, spaced along sidewalls 142 as outriggers 102 and retention flanges 108 are spaced along lower backshell 14, each for receiving one of the retention flanges 108 to secure a respective cover 8 or 10 to backshell 14.

Proximate region 156 covers 8 and 10 have on opposite sides thereof, near sidewalls 142, a post socket 160 and a post 162. Post socket 160 and post 162 extend beside sidewalls 62 and anchoring flange 90. As best seen in FIGS. 1, 9, 10 and 11 posts 162 extend substantially above sidewalls 142 and have a chamfer 164 at the distal end to assist in post 162 in one of covers 8 or 10 to align with and be received in a post socket 160 of the other cover. In the preferred embodiment, post 162 is cylindrical while post socket 160 has a polygonal cross section. Post socket 160 and post 162 are sized to form an interference fit. The interference fit provided by post 162 and post socket 160 supplement flanges 108 of outriggers 102 to secure covers 8 and 10.

Covers 8 and 10 are molded of a suitable dielectric material. In the preferred embodiment, covers 8 and 10 are identical, and hermaphroditic. Therefore only one will be described in detail. It is noted that the covers need not be identical or hermaphroditic to practice the invention.

Covers 8 and 10 have a major wall 140 having side edges from which extend sidewalls 142. Sidewalls 142 of covers 8 and 10 extend normal to major wall 140 to cover a portion of the sidewalls 54 and 78 of respective backshells 12 and 14. The forward part 144 of major wall 140 is offset from the plane of the major wall, outwardly from the cavity 146 formed by major wall 140 and sidewalls 142. Forward part 144 of covers 8 and 10 cover respective plates 66 and 82 of respective backshells 12 and 14. Covers 8 and 10 are open at the forward end 148 where connector 4 egresses from cavity 146. A rear wall 150, which need not be coplanar, is formed with a semicircular jack screw receiving recess 152 proximate each sidewall 142. These semicircular recesses on covers 8 and 10 form a circular opening when the covers are assembled. Between the recesses 152 covers 8 and 10 have a centrally located cable egress 154 which, when the covers are assembled, permit cable C to pass therethrough. Forward of cable egress 154 each cover 8 and 10 has a region 156 for receiving the corresponding anchoring member 56,86 of backshells 12 and 14.

Transverse walls 164 extend inward toward cavity 146, normal to sidewalls 142, each having an arcuate, semicircular jack screw receiving recess 166 therein aligned with respective jack screw recesses 152. Pairs of transverse walls 164 extending from each sidewall 142 define channels 168 for receiving a respective one of supporting strips 104 of out riggers 102 on shell 14. Bridging walls 170 connect some of the transverse walls 164 at their inner ends. Forward of forward-part 144 are cut-outs 172 for receiving pivot hooks 72 of a respective backshell 12 or 14.

The forward end of the cover 8 is open, excepting for a rudimentary front wall 178 having a key receiving recess 180, behind which is a keying flat 182 extending tangentially of the recess 180 but being located therebelow.

Figure 12:
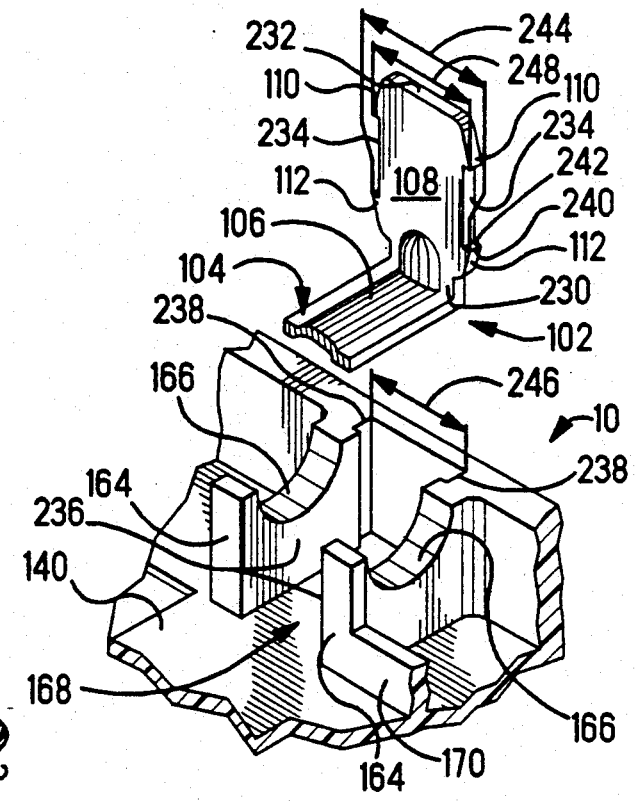
FIG. 12 is an exploded side view shown partly in section, illustrating aspects of the assembly of the connector covers to the lower back shell.

After conductors of the cable have been terminated to contacts of the connector and upper and lower backshells 12 and 14 have been secured together, covers 8 and 10 are secured to lower backshell 14. As best seen in FIG. 12, which is typical of four locations of the lower cover 10 and lower backshell 14, with cover 10 positioned below backshell 14 an outrigger 102 is positioned above a channel 168. Retention flange 108 is integral with and extends from supporting strip 104 at base 230 and extends to distal end 232. Retention flange 108 is spaced from sidewalls of backshell 14 at the end of supporting strip 104 and extends substantially parallel to the sidewalls of the backshell. Retention flange 108 is defined by lateral edges 234 from which extend upper retention barbs 110 and lower retention barbs 112. Lower retention barbs 112 taper outwardly in a direction from base 230 toward distal end 232 to a tip 240, terminating in a shoulder 242 facing opposite to the direction of insertion. Retention flange 108 is sized to be received in channel 168 with lower retention barbs 112 biting into channel walls 236. Channel walls 236 may have offsets 238, forming a T-shaped channel, for receiving retention flange 108.

Figure 13:
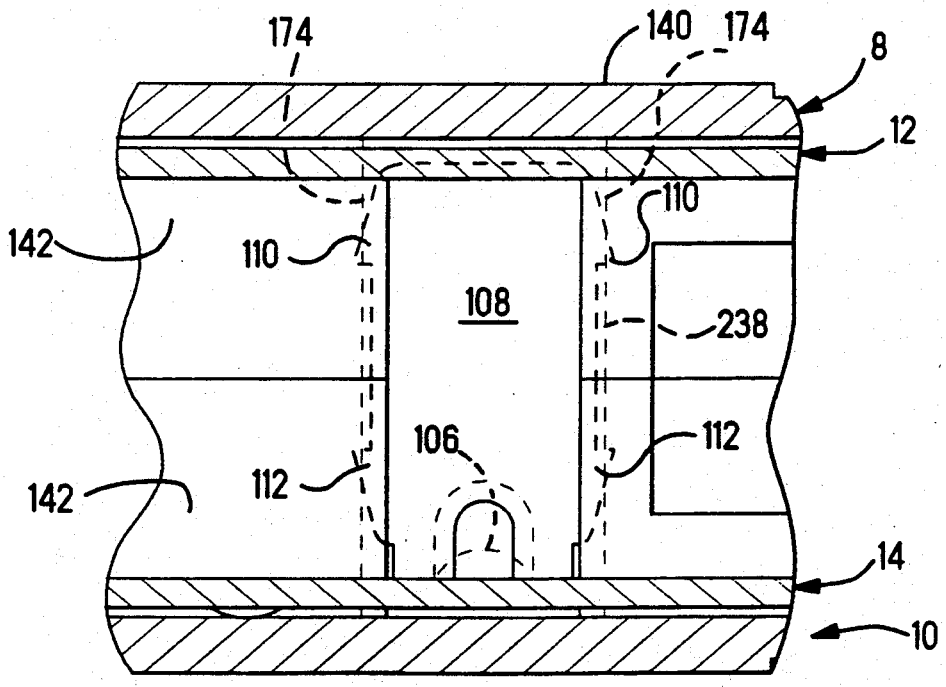
FIG. 13 is an enlarged fragmentary view illustrating details of securing the connector covers to the lower backshell.
Figure 14:
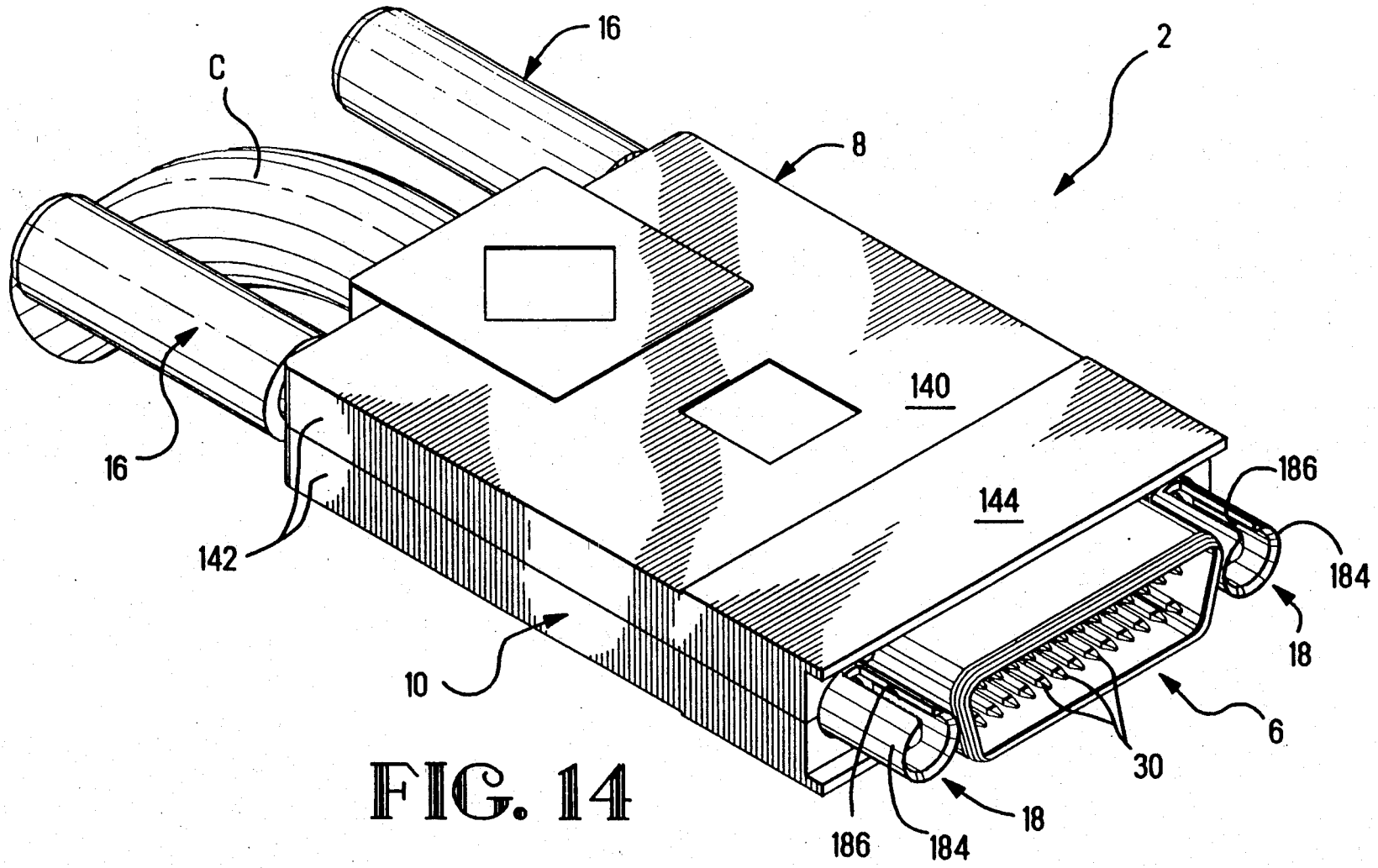
FIG. 14 is an isometric view taken from the front, showing the connector assembly in its fully assembled condition, with a multi-wire cable terminated to the connector.
Figure 15:
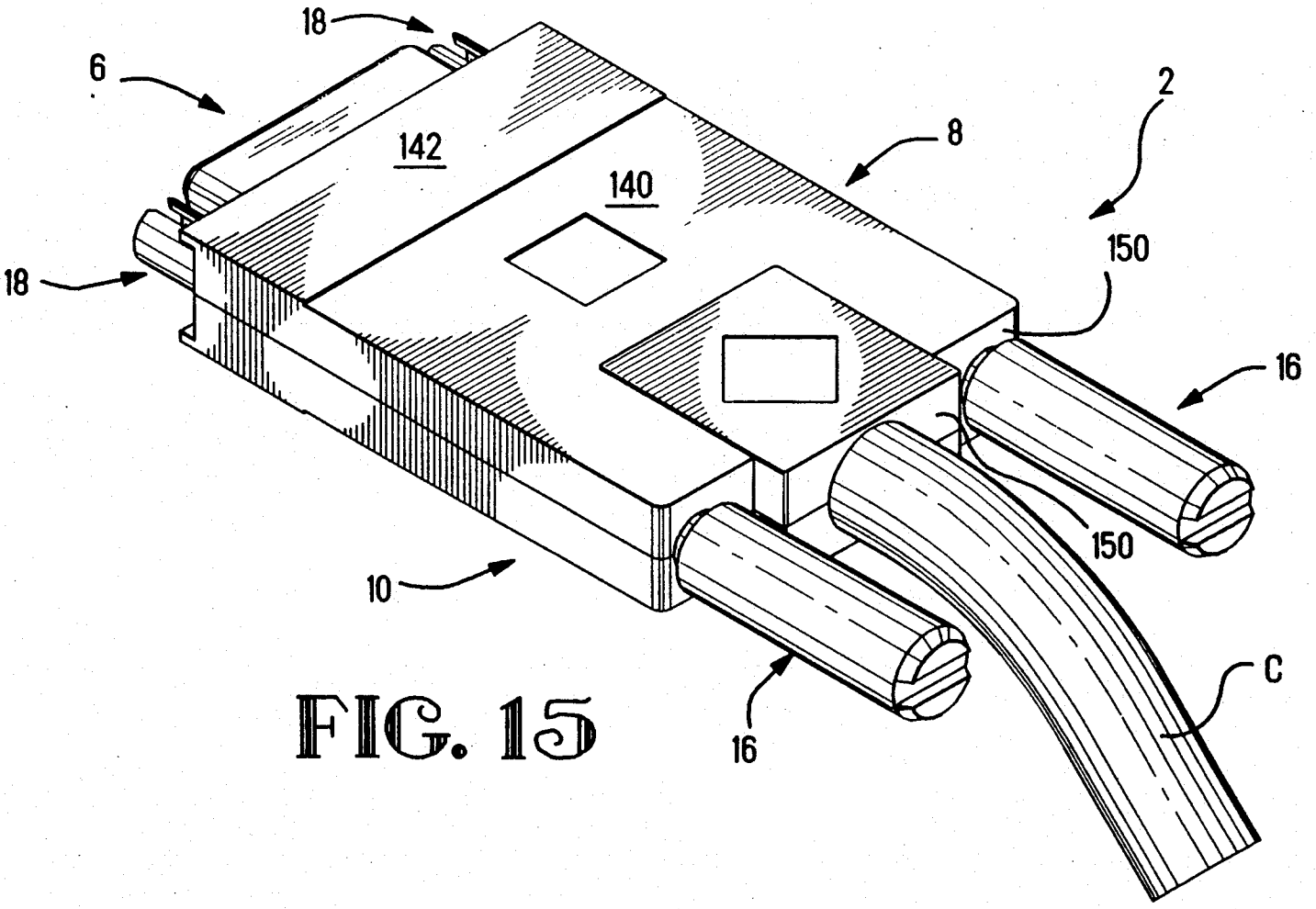
FIG. 15 is a view similar to FIG. 13 taken from the rear of the connector assembly.
Figure 16:
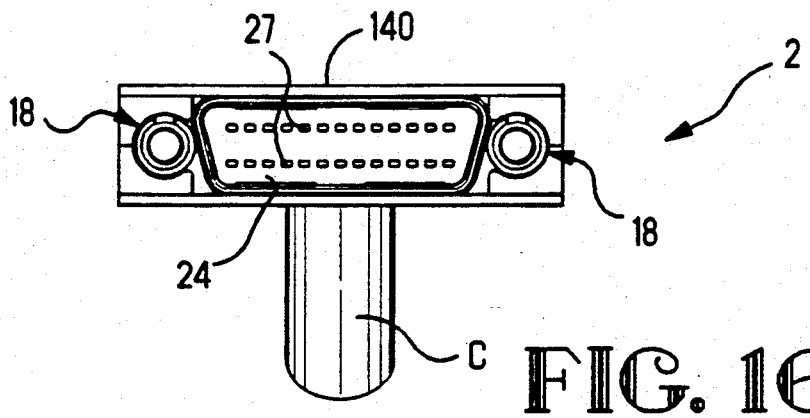
FIG. 16 is a reduced front view of the assembly of FIGS. 14 and 15.
Figure 17:
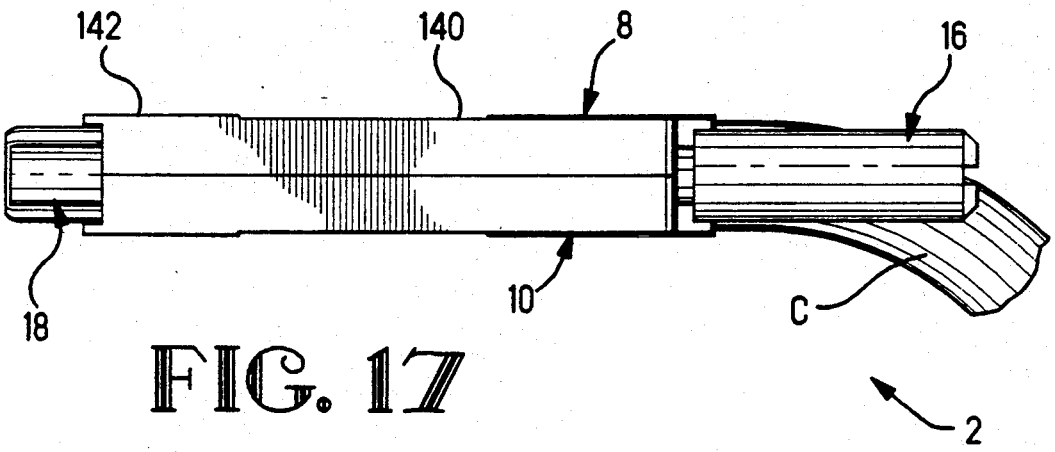
FIG. 17 is a side view of the assembly of FIGS. 14 and 15.
Figure 18:
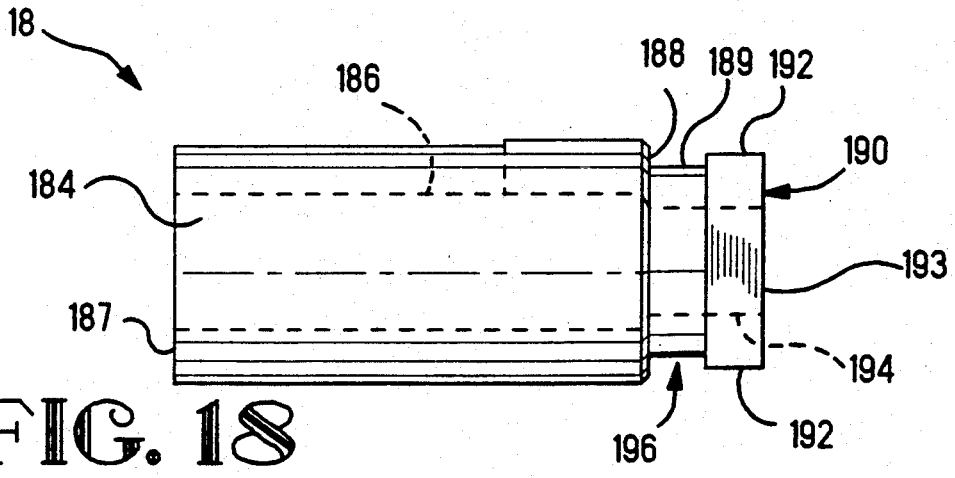
FIG. 18 is a side view of one of the keys.

The distance between tips 240, distance 244, of lower retention barbs 112 is greater than the spacing between channel walls 236 where the retention flange 108 is received. In the preferred embodiment, dimension 244 is greater than the spacing 246 between offsets 238. As retention flange 108 is moved into channel 168, retention barbs 112 bite into channel walls 236, specifically offsets 238, with the dielectric material of the cover cold flowing behind shoulder 242 to retain lower cover 10 on lower backshell 14, as best seen in FIG. 13. Lower cover 10 and backshell 14 are moved together until they engage as shown in FIG. 13.

Upper retention barbs 110 are similar in structure to lower retention barbs 112, but reversed in the direction of taper due to the direction of insertion into a channel 168 in upper cover 8, relative to retention flange 108. The tip-to-tip distance 246 of upper retention barbs is greater than the spacing between channel walls in upper cover 8 in which retention flange 108 is received, as shown in FIG. 13. Since in the preferred embodiment covers 8 and 10 are identical, upper retention barbs are received in a channel 168 engaging channel sidewalls 236 with the result that distances 244 and 246 are the same.

Upper cover 8 is pressed onto flange 108 until sidewalls 142 of upper cover 8 engage sidewalls 142 of lower cover 10 as shown in FIG. 13. In this manner the covers 8 and 10 are secured to the lower backshell and form a part of connector assembly 2. Cover retention may be supplemented over that provided by outriggers 102, such as by a post 162 on one cover being received in an interference fit in a socket 160 of the other cover.

Upper and lower retention barbs 110,112 provide spaced opposed barbs on flange 108 to secure covers 8 and 10 to lower backshell 14. Upper retention barbs 110 provide a pair of opposed barbs, laterally transverse of flange 108 of backshell 14, to secure upper cover 8 thereto. Lower retention barbs 112 provide a pair of opposed barbs, laterally transverse of flange 108 of backshell 14, to secure upper cover 8 thereto. Outriggers are typically placed on opposed sides of lower backshell 14 to provide symmetrical retention forces. As can be seen from FIG. 1, outriggers 102 may be placed at spaced axial locations along each side of lower backshell 14.

While the invention has been described as having all outriggers on the lower backshell, and no outriggers on the upper backshell, the invention is not limited thereto. All of the outriggers could be positioned on the upper backshell, or there could be at least one outrigger on each backshell.

Each key 18, in the preferred embodiment has been die cast in one piece, preferably from zinc, and then tin plated. As best seen in FIGS. 1, 7, 9 and 18, each key comprises a keying portion in the form of a circular cross section, hollow, forwardly open keying shaft 184 having an axial blind keying slot 186 opening into its forward end 187. From a rear end wall 188 of the shaft 184 there extends, co-axially therewith, a neck 189 (FIG. 18) supporting at its rear end, a keying abutment 190 which is, in the preferred embodiment, of regular polygonal shape as viewed in cross section normal to the axis of the key 18. The polygonal shape permits key 18 to be oriented to any one of several orientations, typically the number of orientations corresponding to the number of sides of the polygon, with slot 186 correspondingly taking on one of the several possible orientations. The regular polygonal shape in the preferred embodiment is square so that the keying abutment 190 has four flats 192 at right angles to each other. The rear surface of abutment 190 defines the rearward end 193 of key 18.

There extends through the abutment 190, the neck 189 and the wall 188, a smooth, jack screw receiving bore 194 co-axial with the shaft 184 and communicating with the interior thereof. The abutment 190, the neck 189 and the wall 188 co-operate to define a recess 196 extending about the neck 189. Recess 196 receives a respective flange 114 of the back shell 14 so that neck 189 is received in slot 116 of flange 114, and a respective flange 42 of the drawn shell 6, so that the neck 189 is also received in the slot 44 of the flange 42.

Figure 7:
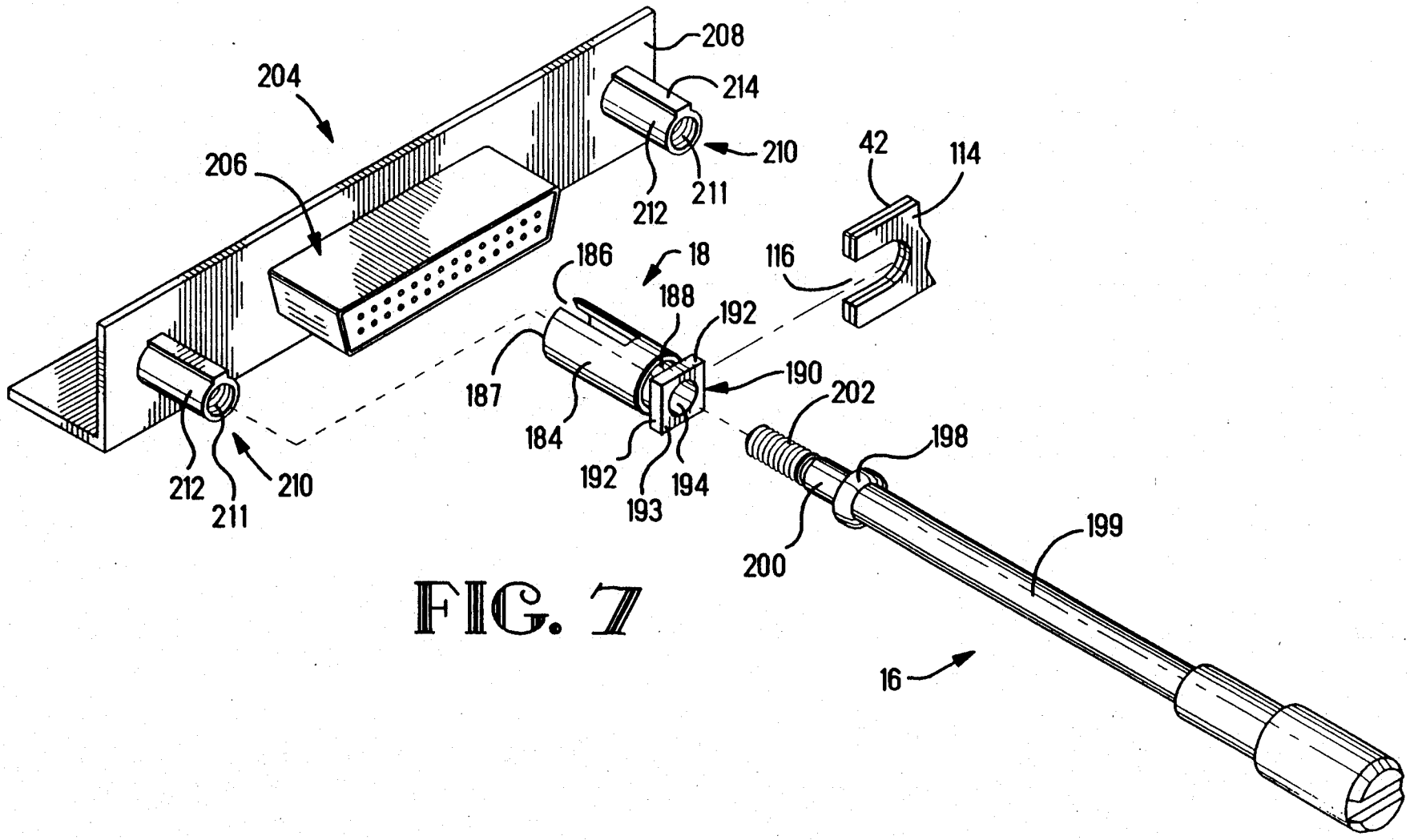
FIG. 7 is an exploded isometric view illustrating the assembly of a jack screw to a key and a second electrical connector having complementary keys.
Figure 8:
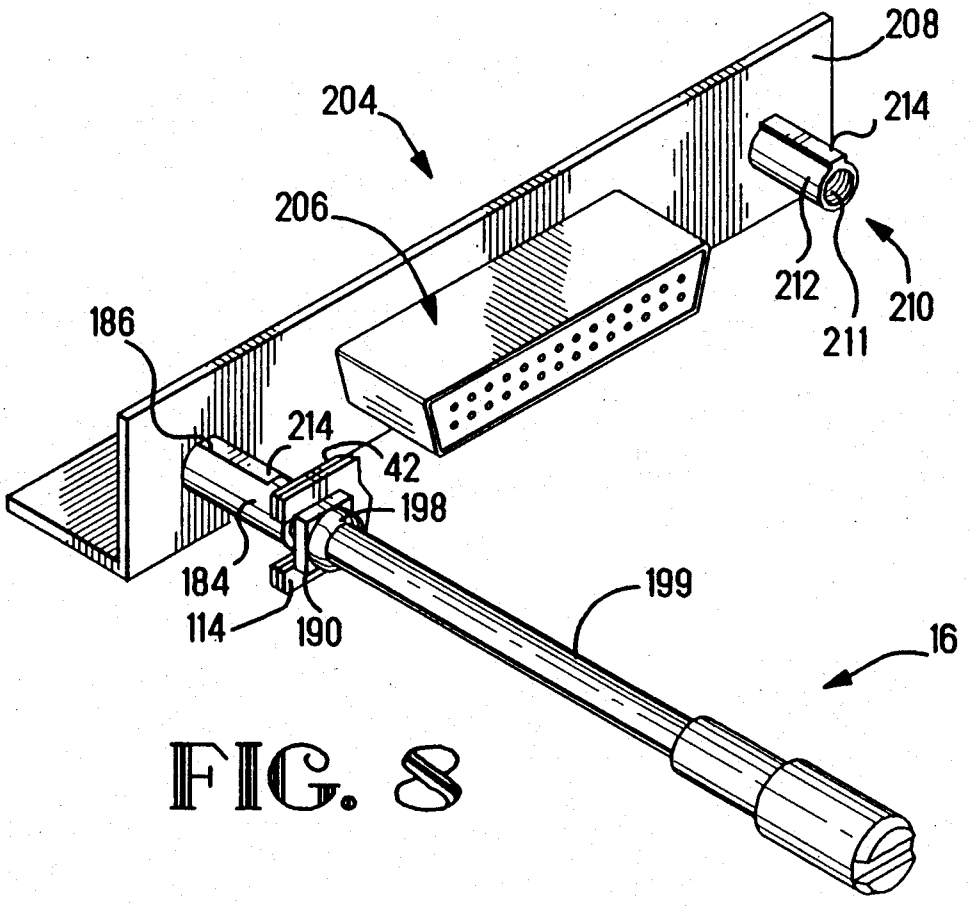
FIG. 8 is an isometric view similar to that of FIG. 7 but showing the jack screw assembled to the key and the key mated with one of the complementary keys.

Each jack screw 16 has, towards the forward end of its shaft 199, a collar 198 for engaging the abutment 190 and specifically rearward end 193. Forwardly of the collar 198 each jack screw 16 has a smooth section 200 for reception in the bore 194 and a threaded section 202 for reception in a threaded bore 211 of a respective mating jack screw (not shown) for securing the assembly 2 to a mating electrical connector assembly 204. The mating electrical connector assembly 204 comprises a mating connector 206 is shown in FIGS. 7 and 8 having a forward face 208.

There is fixed to each end of forward face 208 a complementary key 210 for mating with a respective key 18 of the assembly 2. Each complementary key 210 comprises a hollow shaft 212 having a threaded bore 211 for receiving the threaded section 202 of a respective one of said mating jack screws 16. Each complementary key 210 is sized to be received in the shaft 184 of a respective key 18. The shaft 212 has an external axially extending keying rib 214 for reception in the keying slot 186 of said respective key 18, as shown in FIG. 8. Typically, keying rib 14 could be positioned around the periphery of shaft 212 at any one of the possible locations that slot 186 could take on due to the angular orientation of key 18 about its axis. Keys 18 can be mated with a complementary key 210 only when the angular orientation of both keys is such that the rib 214 of complementary key 210 is aligned with slot 186 of key 18. Thus, connector assembly 2 can mate with mating connector assembly 4 only when the keys 18 are oriented such that respective slots 186 are aligned with respective keying ribs 214 on complementary keys 210.

Figure 9:
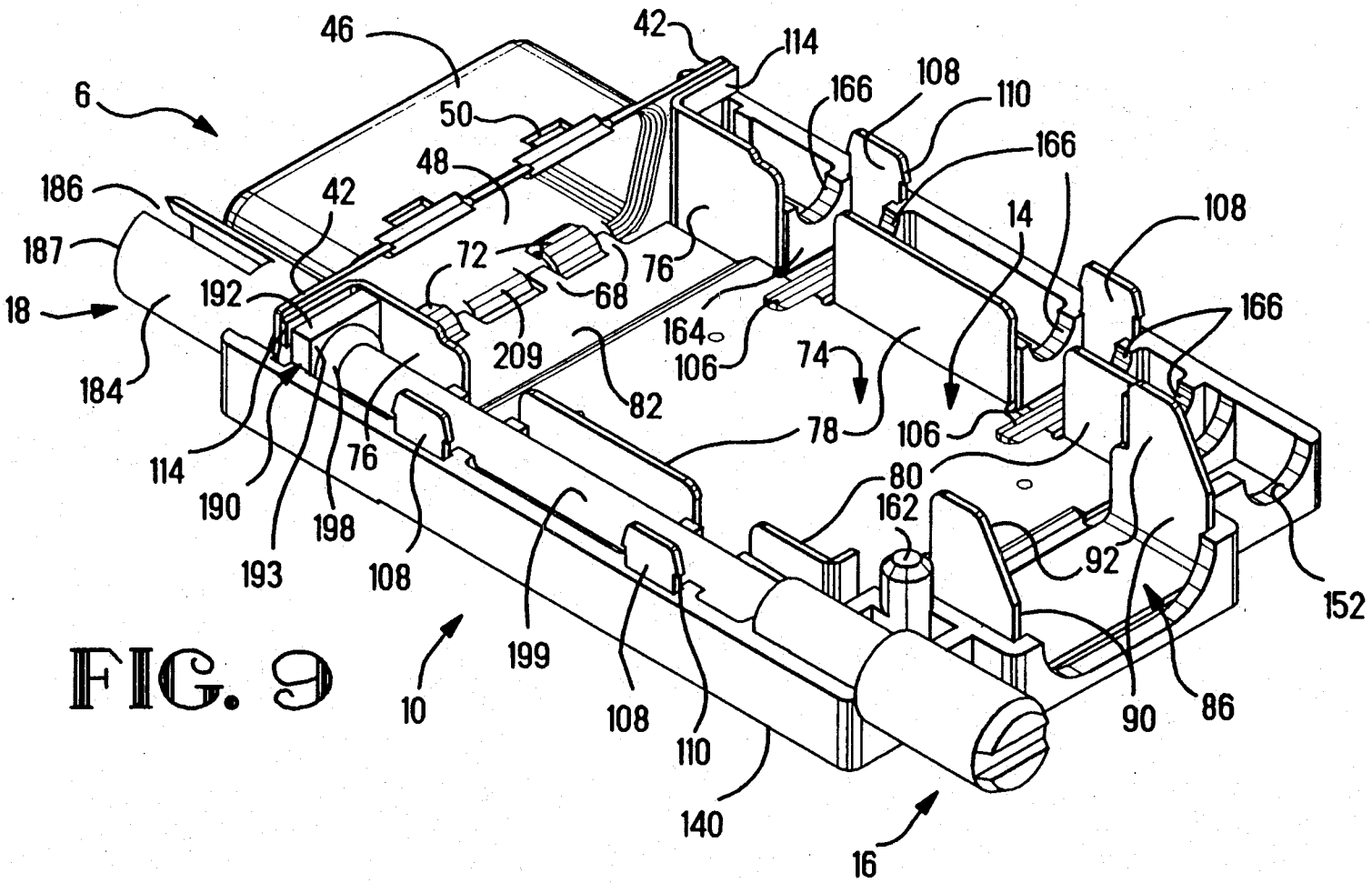
FIG. 9 is an isometric view illustrating the assembly of the lower back shell to the lower connector cover, one of the jack screws, and one of the keys being shown in their assembled relationship to the lower back shell and the lower connector cover.
Figure 10:
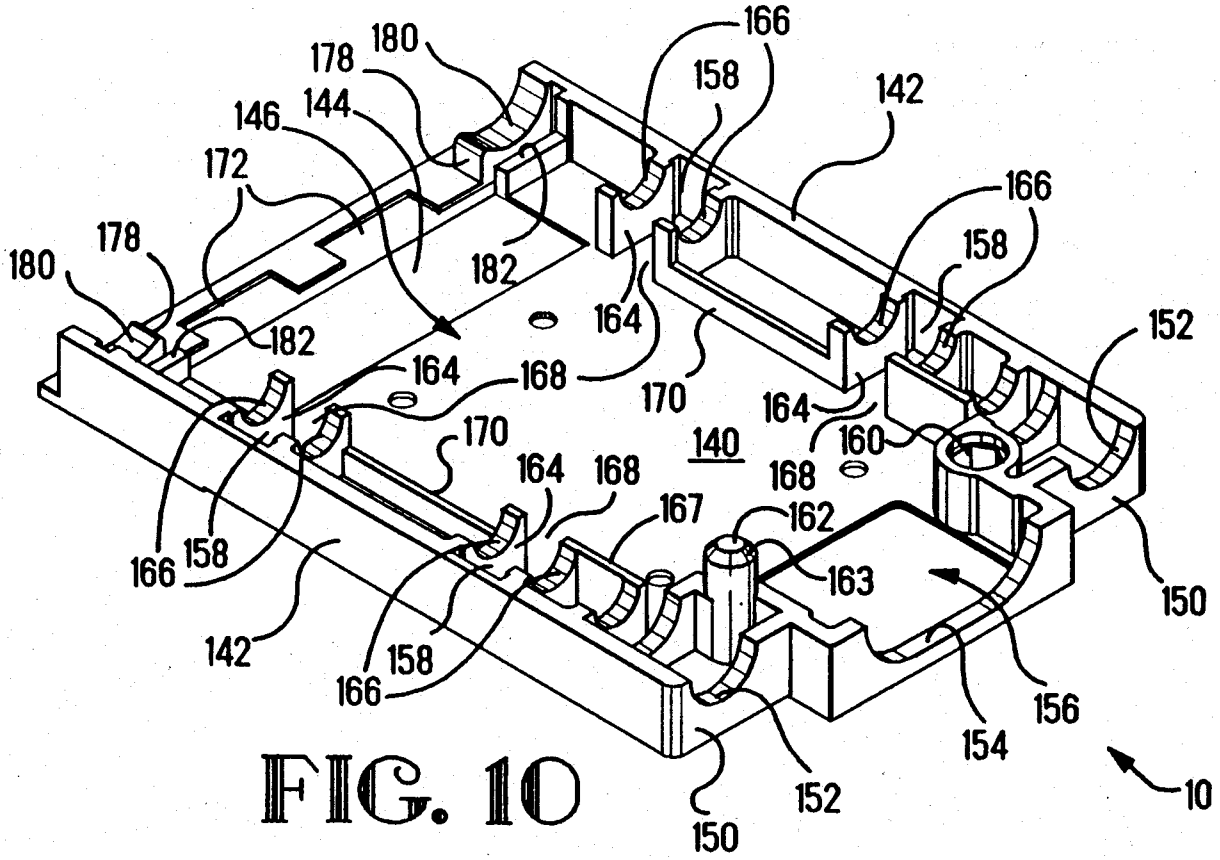
FIG. 10 is an isometric view of the lower connector cover.

When the shells 6, 12 and 14 have been mated as described above with reference to FIGS. 2 to 6, the flanges 42 and 114 of each pair of abutting flanges 42 and 114 of the shells 6 and 14 are inserted into the recess 196 of a respective key 18 as shown in FIGS. 1 and 9. As best seen in FIG. 9, one of the flats 192 of the keying abutment 190 is in contact with the adjacent wall section 76 of the shell 14. This maintains key 18 in a particular one of the possible orientations. The lower back shell 14 is then placed in the lower cover 10, as shown in FIG. 9, which in the interest of simplicity depicts only the drawn shell 6, the lower back shell, the lower cover 10 and only one of the jack screws 16 and keys 18. The shell 14 is secured to the cover 10 by the reception of the flanges 108 of the outriggers 102 each in a respective channel like recessed 58 of the cover 10, the lower barbs 112 of the flanges 108 biting into the transverse walls 174 of the cover 10, as will best be apparent from FIG. 11.

Each jack screw 16 is then inserted through the respective recess 152 of the cover 10, and through the recesses 166 aligned with said recess 152, so that the section 200 of the jack screw 16 is received in the bore 194 of the respective key 18, the section 202 of the screw 16 being received in the shaft 184 of the key 18 and the collar 198 of the screw 16 engaging the keying abutment 190, specifically rearward end 193, of the key 18. One of the flats 192 of each abutment 190 lies in surface to surface contact against the respective keying flat 182 of the cover 10, the shaft 184 of each key 18 lying in the adjacent recess 180 of the cover 10. By virtue of the surface to surface engagement of one of the flats 192 of each abutment 190 against the adjacent flat 182 and the adjacent wall section 76 of the shell 14, each key 18 is firmly secured against rotation, whereby its slot 186 always remains angularly oriented in a position determined by the flats 192 that have been selected to engage the said flat 182 and the wall section 76. The key 18 is secured against axial movement by the flanges 42 and 114. In its inserted position, each jack screw 16 extends between the outrigger flanges 108 and the wall sections 76, 78 and 80 on the respective side of the shell 14. A central flange 209 on the wall 48 of the shell 6 engages between the two inner flanges 68 of the plate 82 as shown in FIG. 9. A strain relief member 86 of the shell 14 is received in the emplacement 168 of the cover 10. The back shell 14 is laterally located in the cover 10 by the inner ends of the transverse walls 162 and the bridging walls 167.

The cover 8 is now mated with the cover 10 so that the post 162 of the cover 8 mates with the socket 160 of the cover 10 and the post 162 of the cover 10 mates with the socket 160 of the cover 8. Each flange 108 of the shell 14 is received in a respective groove 152 of the cover 8 so that the upper barbs 110 of the flange 108 bite into the walls of the groove so that the cover 8 is firmly retained in its mated relationship of the cover 10.

Be it noted that the side walls 54 of the upper back shell 12 cover the spaces between the wall sections 76, 78 and 80 of the lower back shell 14, as best seen in FIG. 5, so that the wires within the back shells are completely shielded.

FIGS. 14 to 17 show the completed assembly 2 with the keys 18 projecting forwardly of the assembly on opposite sides of the shell 6 for mating with the keys 210 of the mating connector assembly 204, as shown in FIG. 8 in respect of only one key 18 and one key 210.

Be it noted that each of the back shells 12 and 14 is a one-piece item that has been stamped and formed from a single piece of sheet metal stock, each of the covers 8 and 10 being a one-piece plastics molding. The keys 18 are one-piece castings.

I claim:

1. A one piece cast metal key for mating with a tubular cylindrical mating keying member having an external axial keying rib thereon, the key comprising a keying part extending rearwardly from a forward end, a neck extending rearwardly from said keying part and supporting at its rear end a keying abutment of regular polygonal cross-sectional shape larger in width than said neck, said key further including an axial bore therethrough extending from said forward end to said rear end, said keying part including an axial slot opening extending rearwardly from said forward end for receiving therealong said keying rib of said mating keying member, and said rear end adapted to receive insertably thereinto a threaded mating end of jack screw to extend forwardly through and beyond said neck and into said keying part for threadedly engaging a correspondingly threaded aperture into a forward end of said mating keying member.

2. A key as recited in claim 1, wherein said keying abutment has four flat side surfaces.

* * * * *